US008151871B2

(12) United States Patent
Förster et al.

(10) Patent No.: US 8,151,871 B2
(45) Date of Patent: Apr. 10, 2012

(54) HEAT EXCHANGER

(75) Inventors: Uwe Förster, Erdmannhausen (DE); Kurt Molt, Bietigheim-Bissingen (DE)

(73) Assignee: BEHR GmbH & Co. KG, Stuttgart (DE)

( * ) Notice: Subject to any disclaimer, the term of this patent is extended or adjusted under 35 U.S.C. 154(b) by 1295 days.

(21) Appl. No.: 10/586,861

(22) PCT Filed: Dec. 8, 2004

(86) PCT No.: PCT/EP2004/013975

§ 371 (c)(1),
(2), (4) Date: Jul. 21, 2006

(87) PCT Pub. No.: WO2005/071344

PCT Pub. Date: Aug. 4, 2005

(65) Prior Publication Data

US 2007/0151714 A1 Jul. 5, 2007

(30) Foreign Application Priority Data

Jan. 23, 2004 (DE) ..... 10 2004 003 789

(51) Int. Cl.
*F28F 9/02* (2006.01)
*B21D 51/38* (2006.01)

(52) U.S. Cl. ..... 165/173; 165/174

(58) Field of Classification Search ..... 165/173, 165/174, 175, 176, 153; 29/890.052
See application file for complete search history.

(56) References Cited

U.S. PATENT DOCUMENTS

| | | | | |
|---|---|---|---|---|
| 5,236,044 | A | 8/1993 | Nagasaka et al. | |
| 5,479,985 | A * | 1/1996 | Yamamoto et al. | 165/126 |
| 5,582,239 | A * | 12/1996 | Tsunoda et al. | 165/76 |
| 5,605,191 | A | 2/1997 | Eto et al. | |
| 5,765,633 | A * | 6/1998 | Hu | 165/174 |
| 6,082,448 | A * | 7/2000 | Haussmann | 165/174 |
| 6,202,741 | B1 * | 3/2001 | Demuth et al. | 165/176 |
| 6,216,776 | B1 * | 4/2001 | Kobayashi et al. | 165/173 |
| 6,302,196 | B1 * | 10/2001 | Haussmann | 165/153 |
| 6,581,679 | B2 * | 6/2003 | Fischer et al. | 165/174 |
| 6,745,827 | B2 * | 6/2004 | Lee et al. | 165/144 |
| 2003/0066633 | A1 * | 4/2003 | Lee et al. | 165/144 |
| 2003/0221819 | A1 | 12/2003 | Jang | |

FOREIGN PATENT DOCUMENTS

| | | | |
|---|---|---|---|
| DE | 43 05 060 | A1 | 8/1994 |
| DE | 44 32 972 | A1 | 4/1995 |
| DE | 93 18 525 | U1 | 5/1995 |
| DE | 691 10 725 | T2 | 11/1995 |
| DE | 196 03 016 | A1 | 7/1996 |

(Continued)

*Primary Examiner* — Tho V Duong
(74) *Attorney, Agent, or Firm* — Muncy, Geissler, Olds & Lowe, PLLC

(57) ABSTRACT

The invention relates to a heat exchanger (1), in particular, a gas cooler for a vehicle air-conditioning unit, comprising several flat tubes (2) arranged in two or more parallel rows, a collector tube (6), with one or more longitudinal separating walls (12), running along the longitudinal axis of the collector tube (6), dividing the collector tube (6) into two or more collector channels, whereby the collector tube (6) is embodied from two metal sheets (8) and openings (4) are provided in at least one of the metal sheets (8), for accommodating the ends of the flat tubes (2). Each longitudinal separating wall (12) is provided with tongue-like projections (14), arranged in grooves (16) in at least one of the metal sheets (8) and fixed on the outer side of the metal sheet (8).

8 Claims, 6 Drawing Sheets

FOREIGN PATENT DOCUMENTS

Figure 1:
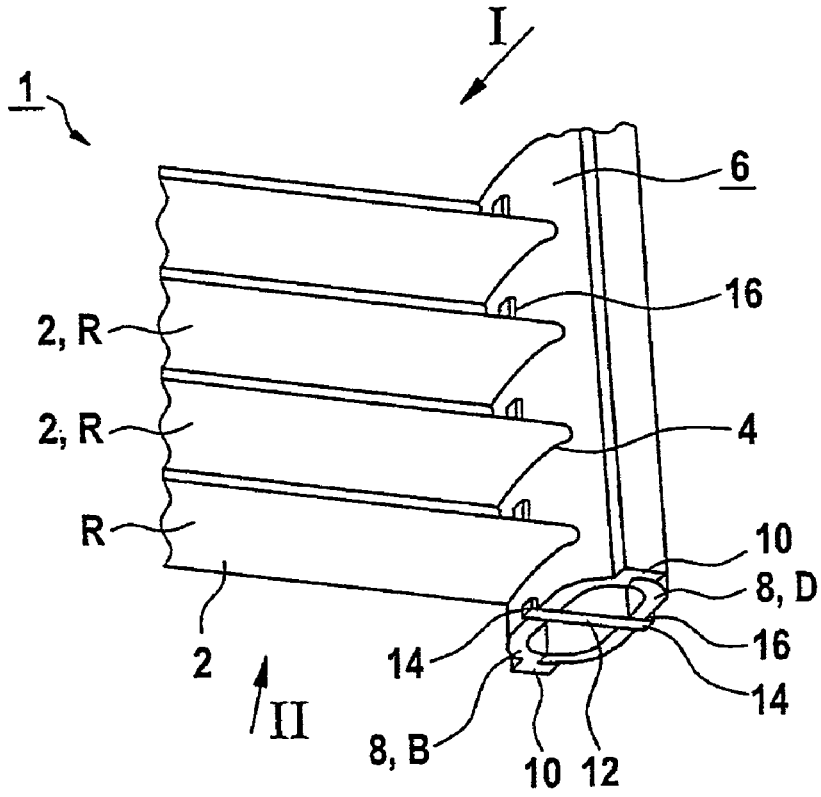

| | | | |
|---|---|---|---|
| DE | 195 15 530 | A1 | 10/1996 |
| DE | 197 19 255 | A1 | 11/1998 |
| DE | 199 06 289 | A1 | 8/1999 |
| DE | 199 42 458 | A1 | 3/2000 |
| EP | 1 298 401 | A2 | 4/2003 |
| JP | 2004-184001 | A | 7/2004 |

* cited by examiner

HEAT EXCHANGER

The invention relates to a heat exchanger, in particular a gas cooler for a vehicle air-conditioning unit, comprising several flat tubes arranged parallel to one another in two or more rows and a collector tube, into which the flat tubes discharge.

A heat exchanger of the kind referred to by way of introduction is described in DE 199 06 289 A1. In this heat exchanger, the collector tube consists of a housing bottom sheet and a housing top sheet with a complex cross sectional contour achieved by a process of extrusion, of which the side walls overlap one another to form a cavity, in conjunction with which both housing sheets each possess a central wall executed in a single piece and extending in a longitudinal direction, so that the cavity formed from the housing bottom sheet and the housing top sheet is subdivided into two collector channels by means of the longitudinal separating wall formed by the central walls of the housings. The flat tubes are attached to the collector tube in such a way that they discharge into both collector channels via openings in one of the housing sheets provided for the purpose, in conjunction with which the central wall of the housing sheet containing the opening is not present in the area of the opening, and the flat tubes are introduced into the openings in the collector tubes only to the extent that an interruption in the longitudinal separating wall formed by the central wall of the other housing sheet remains ahead of the discharge opening of each of the flat tubes, which interruption constitutes a flow transition between the collector channels. The proposed solution requires a high level of expenditure for the manufacture of the extrusion profiles.

Another variant of heat exchangers of the kind in question is proposed in DE 43 05 060 C2. In this heat exchanger, each of the collector tubes is manufactured from several sheet metal component parts by a soldering process. The flat tubes discharge into the collector tubes, which are also subdivided by longitudinal separating walls into collector channels, in such a way that a flow connection is present only between the flat tube in each case and a collector channel. What is more, the longitudinal separating walls together with the bottom and top component parts forming the collector tubes are attached by soldering in a secure and essentially liquid-tight manner. One or more of the longitudinal separating walls are provided with a flow transition for the purpose of forming predetermined flow paths over at least one longitudinal section. Elongated holes are provided for this purpose in the one or more longitudinal sections of the longitudinal separating walls.

It has emerged that, in the heat exchanger according to DE 43 05 060 C2, the connections between the longitudinal separating walls and the bottom or top in the case of heat exchangers intended for a $CO_2$ cooling medium circuit do not possess adequate strength on account of the rather high pressure level, as a consequence of which this design cannot be retained for such gas coolers. A disadvantage also associated with the proposed heat exchanger is that the flat tubes in each case discharge into only a single collector channel.

Taking the prior art as the starting point, the object of the present invention is to make available a heat exchanger which can be produced economically from pressed sheet metal component parts, and which exhibits adequate strength in respect of the internal pressures arising inside gas coolers. A further object of the invention is to make a flow connection possible by simple means between the flat tubes and all the collector channels on the one hand, and the collector channels between themselves on the other hand.

These objects are achieved in accordance with the invention by means of a heat exchanger having the characterizing features of the independent claim 1.

The heat exchanger in accordance with the invention comprises several flat tubes arranged parallel to one another together with at least one collector tube. The collector tube is subdivided into two or more collector channels by one or more longitudinal separating walls. The collector tube consists of two metal sheets, in particular one bottom sheet and one top sheet, which are embodied as pressed sheet metal component parts. Alternatively, the collector tube can be executed in a single part from an appropriately bent tube and in particular from an omega-shaped tube.

The ends of the flat tubes discharge via openings in at least one of the metal sheets into the collector tube. The longitudinal separating walls also consist of sheet metal. Each longitudinal separating wall possesses tongue-like projections, which are inserted into grooves in one of the metal sheets and are fixed on the outside of the metal sheets concerned. The resistance of the collector tube to internal pressure is improved by fixing the tongue-like projections of the longitudinal separating wall to the metal sheet. Furthermore, preassembly of the two metal sheets of the collector tube is also made possible. A heat exchanger executed in this way consists of economical sheet metal component parts and is thus capable of inexpensive manufacture and has a low weight and, at the same time, high strength including in the presence of high internal pressure. The flat tubes discharge into all the collector tubes at the same time, in conjunction with which a flow connection is maintained between neighboring collector channels without the use of additional component parts, so that necessary diversions of the cooling medium flowing through the heat exchanger are reduced. High strength in conjunction with low wall thicknesses is assured in addition by the fixing of the longitudinal separating walls to the housing top sheet.

The tongue-like projections in the grooves are appropriately bent and/or upset around the outside of the metal sheet. In a further embodiment of the heat exchanger, the longitudinal separating wall possesses tongue-like projections on both sides, which are arranged in the associated metal sheet on each side. Preassembly of the collector tube is enabled, for example, by bending or upsetting the tongue-like projections.

The longitudinal separating walls are arranged parallel to the longitudinal axis of the flat tubes and exhibit recesses in the discharge area of each flat tube, which recesses provide a flow connection between neighboring collector channels. To achieve this, the flat tubes are inserted into the openings of the housing bottom sheet and housing top sheet provided for this purpose only to a depth that is smaller than the depth of the recess. In one possible embodiment, the recesses are embodied for this purpose with a tear-shaped form. Alternatively or additionally, the recesses exhibit an inlet area or an outlet area for the flat tube.

Moreover, the longitudinal separating wall adjacent to the recesses can exhibit further overflow openings. In addition, the recesses of the longitudinal separating wall in the area of the openings in one of the metal sheets function as a stop for the tube. This permits the simple assembly of the heat exchanger in the case of an already preassembled collector tube.

In a further embodiment, the longitudinal separating wall alternately possesses recesses and tongue-like projections. This permits adherence to the basic principle of a complete assembly, so that no additional measures need to be taken in order to hold together the heat exchanger, and in particular its collector channels. Simple manufacture is possible in this way, in conjunction with which, on the one hand, considerable flexibility is retained in respect of achievable dimensions and, on the other hand, the risk of leakage points is reduced.

In an alternative illustrative embodiment, the longitudinal separating wall is embodied with tongue-like projections in the form of a tie bolt separating wall executed from several individual tie bolts arranged parallel to one another. In this case the number of tongue-like projections effectively corresponds to the number of tie bolts. Depending on the nature and the embodiment of the tie bolt separating wall, the individual tie bolts can be attached to one another or separately executed. In an attached arrangement of the tie bolts, these preferably exhibit a material section at one end of the tie bolts. In other words: the tie bolt separating wall exhibits the form of a comb.

The advantages that are achieved in accordance with the invention are that the longitudinal separating walls arranged between the metal sheets in the collector tube of the heat exchanger function as stays in the event of the application of internal pressure, and that the resistance to pressure of the collector tube is improved and the preassembly of the collector tube is permitted as a result of the fixing of the longitudinal separating walls to the outsides of the metal sheets. Distortion of the ends of the flat tubes can be avoided in addition, as a consequence of which simple collector tube production and simple and economical bundling of the heat exchanger are possible.

Figure 2:
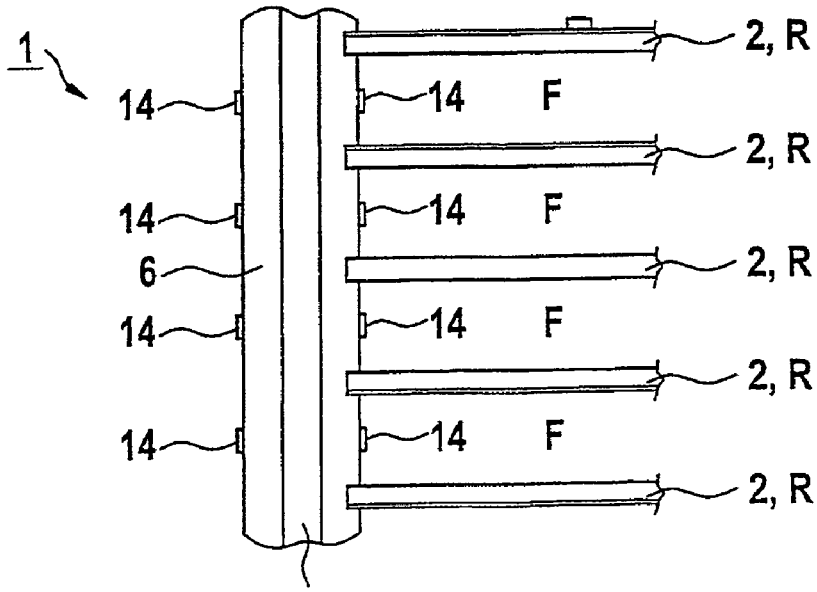
Figure 3:
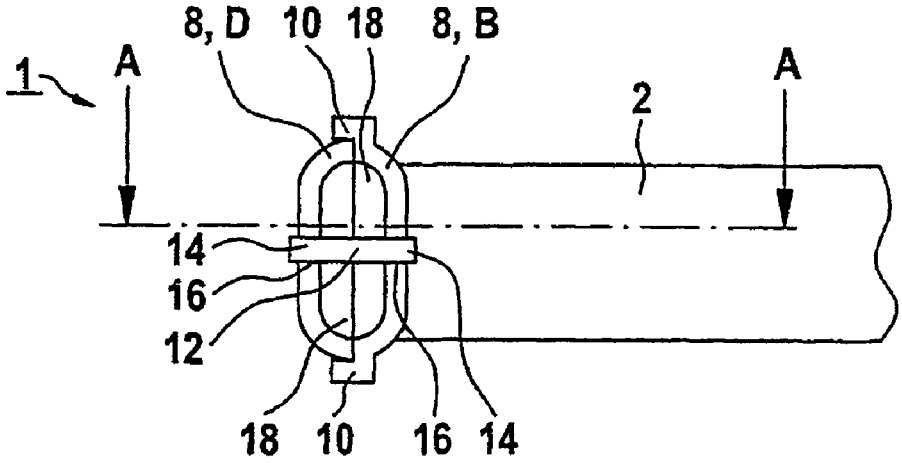
Figure 4:
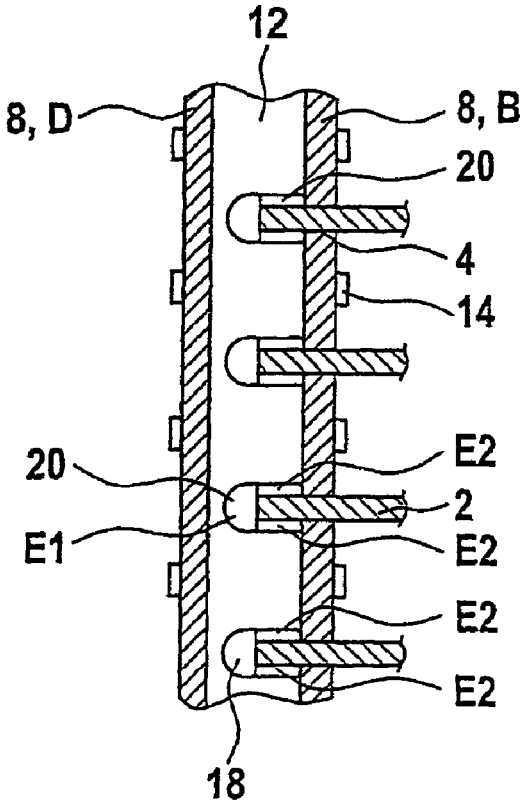
Figure 5:
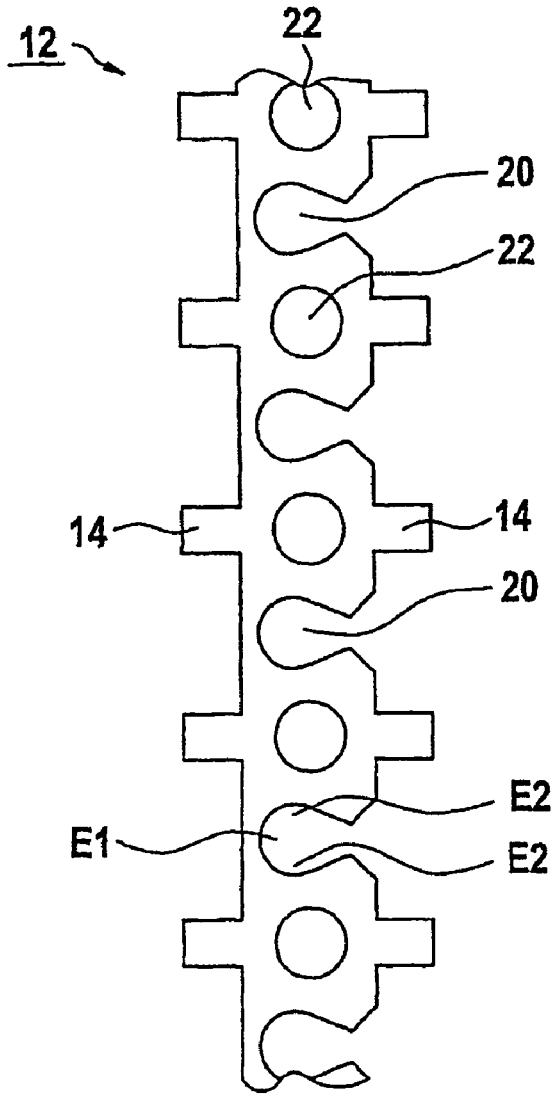
Figure 6:
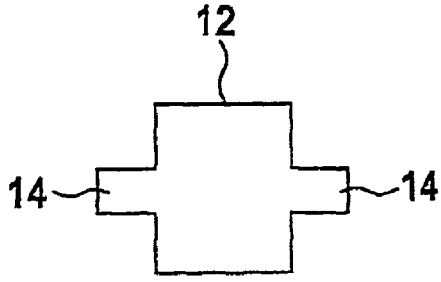
Figure 7:
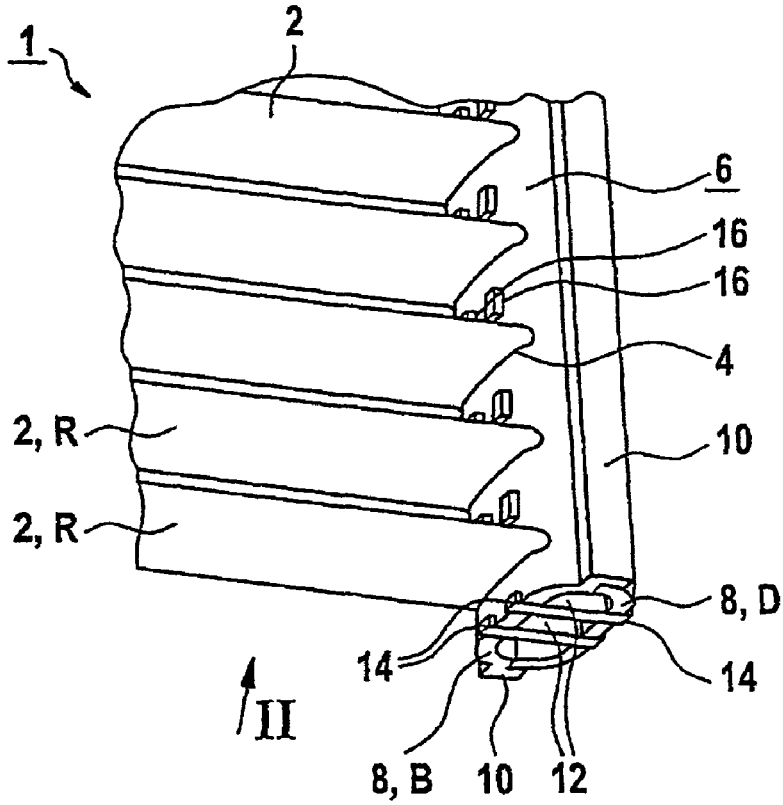
Figure 8:
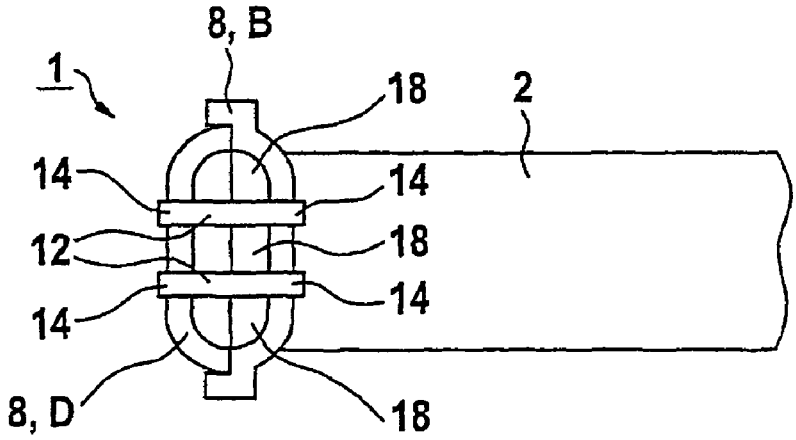
Figure 9:
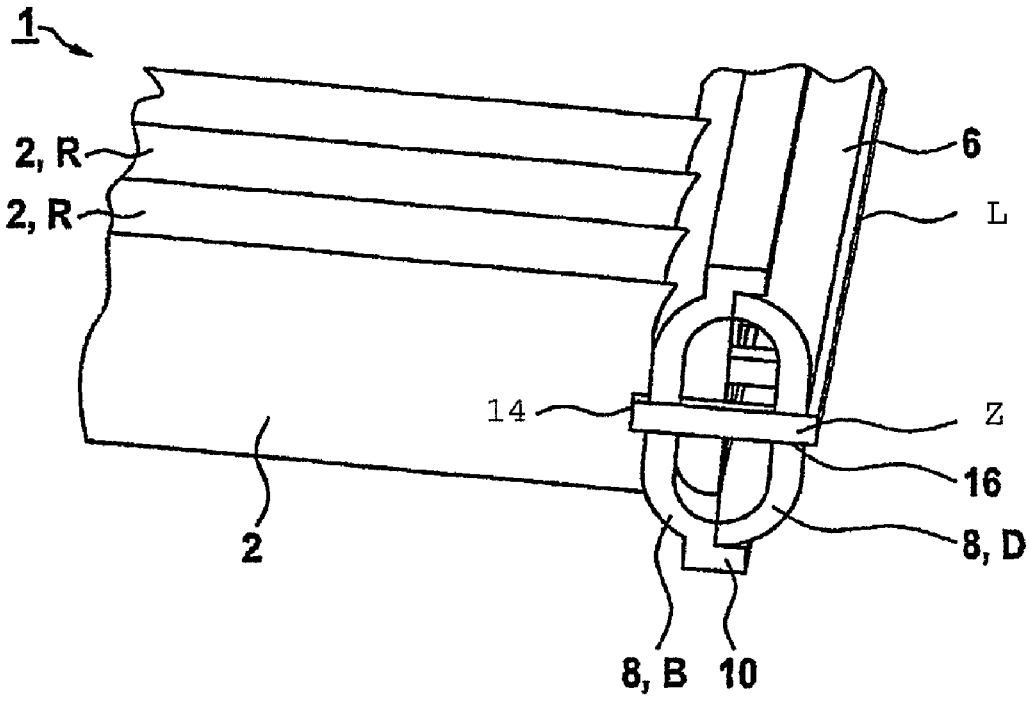
Figure 10:
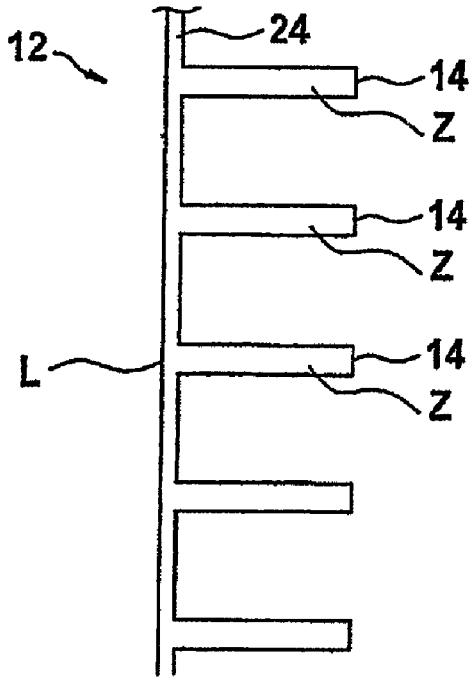
Figure 11:
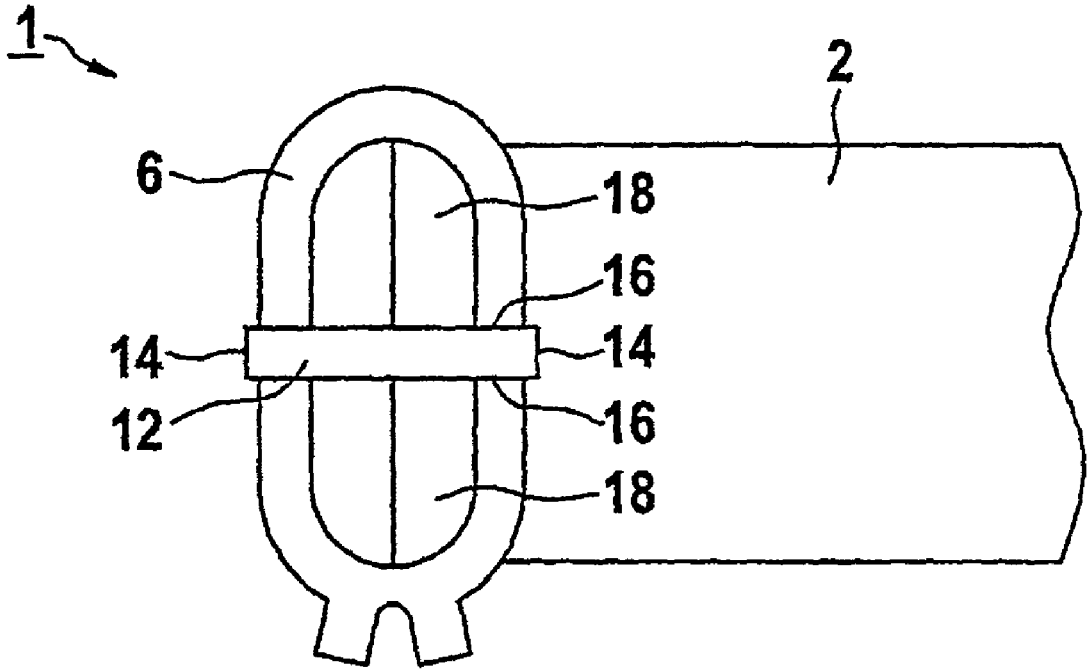

Illustrative embodiments of the invention are explained in greater detail below with reference to a drawing. In the drawing:

FIG. 1 depicts schematically a perspective partial view of a heat exchanger, FIG. 2 depicts schematically a view from above of the heat exchanger according to FIG. 1 in the direction of the arrow I, FIG. 3 depicts schematically a view from above of the heat exchanger according to FIG. 1 in the direction of the arrow II, FIG. 4 depicts schematically a longitudinal section through the heat exchanger according to FIG. 3, FIG. 5 depicts schematically as a view from above a longitudinal separating wall for a collector tube of a heat exchanger, FIG. 6 depicts schematically a longitudinal separating wall in cross section, FIGS. 7, 8 depict schematically an alternative embodiment for a collector tube of a heat exchanger as various views from above, FIGS. 9, 10 depict schematically alternative embodiments for a longitudinal separating wall, in particular for a longitudinal separating wall embodied as a tie bolt separating wall, FIG. 11 depicts schematically an alternative embodiment for a collector tube of a heat exchanger.

Corresponding component parts are provided with the identical reference designations in all the figures.

FIG. 1 depicts a perspective partial view of a heat exchanger 1, for example a gas cooler of an air-conditioning unit for a vehicle.

The heat exchanger 1 comprises several flat tubes 2 arranged parallel to one another in rows R. The arrangement of the flat tubes 2 is also referred to as a tube block. The flat tubes 2 are made from aluminum sheet, for example. The horizontally oriented flat tubes 2 in the illustrative embodiment discharge at each of their ends into openings 4 in a collector tube 6. Only one end of the flat tubes 2 with a collector tube 6 is represented in the illustrative embodiment with a partial view of the heat exchanger 1. The other end of the flat tubes 2, not represented here, discharges into openings of a further collector tube, not represented here, lying opposite the represented collector tube 6.

The collector tube 6 is formed, for example, from two metal sheets 8. The collector tube 6 can exhibit any desired cross sectional form, e.g. oval, round, square. One of the metal sheets 8 serves as a bottom B, and the other metal sheet 8 serves as a top D. The bottom B and the top D are fixed to one another, for example by means of an overlap 10. In other words: the bottom B engages with its longitudinal edges around the top D. The metal sheets 8 are preferably made of aluminum sheet and can be soldered so that they are sufficiently tight in the area of the overlap 10. The bottom B is provided with the openings 4 to accept and accommodate the flat tubes 2.

To improve the resistance to pressure of the collector tube 6 when the heat exchanger 1 is subjected to internal pressure, a longitudinal separating wall 12 is provided in the longitudinal extent of the collector tube 6. The longitudinal separating wall 12 functions as a stay for this purpose. To assure the best possible connection of the top D and the bottom B, the longitudinal separating wall 12 is provided with tongue-like projections 14. The tongue-like projections 14 are arranged for this purpose in grooves 16 in one of the metal sheets 8 and are fixed to the outside of the metal sheet 8. Depending on the design of the longitudinal separating wall 12, this can be provided on both sides with tongue-like projections 14. In this case, grooves 16 to accept the tongue-like projections 14 are provided on both the metal sheets 8, i.e. in the base B and in the top D.

FIG. 2 depicts a view from above of the heat exchanger according to FIG. 1 in the direction of the arrow I. In this case, the tongue-like projections 14 of the longitudinal separating wall 12 project beyond the wall of the collector tube 6 and are fixed on the outside of the collector tube 6, for example bent, upset and/or centre-punched. The longitudinal separating wall 12 in this case is arranged in the collector tube 6 in such a way that the tongue-like projections 14 lie in a free space F formed by the distance between two flat tubes 2. Depending on the nature and execution of the heat exchanger 1, for example ribs, which are not represented here, for torsional rigidity can be provided in this free space F. A heat exchanger 1 of this kind is also designated as a tube rib block.

FIG. 3 depicts the heat exchanger 1 according to FIG. 1 as a view from below in the direction of the arrow II. The longitudinal separating wall 12 subdivides the collector tube 6 into two collector channels 18, which are used for the inflow or outflow of a cooling medium, for example, into the flat tube 2. FIG. 4 depicts a longitudinal section A-A through the heat exchanger 1 according to FIG. 3. The longitudinal separating wall 12 is executed in such a way that it exhibits recesses 20 in the area of the openings 4 in the bottom B to receive the flat tubes 2. The recesses 20 serve to form an inlet area and outlet area E1 for the flat tubes 2 and a flow transition E2 between the collector channels 18 divided by the longitudinal separating wall 12.

Depending on the design of the recesses 20 provided in the longitudinal separating wall 12, these can also serve as a tube stop for the flat tubes 2. Depicted in FIG. 5, for example, as a view from above is a longitudinal separating wall 12 with tear-shaped recesses 20 for a collector tube 6 of a heat exchanger 1. A design of this kind for the recesses 20 permits the fixing and the secure accommodation of the flat tubes 2 in a particularly simple manner with the simultaneous formation of the inlet area and outlet area E1 and the flow transition E2. The recesses 20 can also exhibit any other form, however. In the illustrative embodiment according to FIG. 5, the recesses 20 and the tongue-like projections 14 of the longitudinal separating wall 12 are provided in an alternating sequence. The longitudinal separating wall 12 in this case is provided on one side with the recesses 20 and on both sides with the tongue-like projections 14. Depending on the construction and the function of the heat exchanger 1, the longitudinal separating wall 12 can exhibit any desired combination of recesses 20 and tongue-like projections 14 having any desired different forms.

In addition to the recesses 20, the longitudinal separating wall 12 can exhibit additional overflow openings 22 with any desired geometry. FIG. 6 depicts a longitudinal separating wall 12 with tongue-like projections 14 in cross section.

FIGS. 7 and 8 depict an alternative embodiment for a collector tube 6 of a heat exchanger 1 as various views from above. The collector tube 6 in this case exhibits two longitudinal separating walls 12, each of which is provided with tongue-like projections 14. The tongue-like projections 14 are arranged in openings 4 in the metal sheet 8 executed as the bottom B, where they are fixed, for example by bending over, to the outside of the metal sheet 8. The tongue-like projections 14 are arranged on both sides of the longitudinal separating walls 12 and can be fixed to both metal sheets 8. Depending on the number of the longitudinal separating walls 12, a corresponding number of collector channels 18 is formed in the collector tube 6.

FIGS. 9 and 10 depict an alternative embodiment for a longitudinal separating wall 12 embodied as a tie bolt separating wall 24. The tie bolt separating wall 24 comprises several tie bolts Z arranged parallel to one another, the ends of which form the tongue-like projections 14 in each case. Depending on the nature and design of the tie bolt separating wall 24, the tie bolts Z can be arranged separately in the collector tube 6 for the longitudinal separation. Alternatively, the tie bolts Z can be connected to one another via a longitudinal edge L, as illustrated in FIG. 10. In this illustrative embodiment, the longitudinal separating wall 12 exhibits the form of a comb. The longitudinal edge L then constitutes a continuous tongue-like projection 14 extending along the longitudinal axis of the collector tube 6, which is fixed to the top D, for example by bending over, as illustrated in FIG. 9. FIG. 11 depicts an alternative embodiment for a collector tube 6. Instead of the metal sheets 8, the collector tube 6 is made in a single piece from an appropriately bent tube, for example an omega-shaped tube.

LIST OF REFERENCE DESIGNATIONS

1 heat exchanger
2 flat tubes
4 openings
6 collector tube
8 metal sheet
10 overlap
12 longitudinal separating wall
14 tongue-like projections
16 grooves
18 collector channels
20 recesses
22 overflow openings
24 tie bolt separating wall
B bottom
E top
E1 inlet area and outlet area
E2 flow transition
F free space
L longitudinal edge
R row
Z tie bolt

The invention claimed is:

1. A heat exchanger, in particular a gas cooler for a vehicle air-conditioning unit, having several flat tubes arranged parallel to one another in two or more rows and a collector tube, which exhibits one or more longitudinal separating walls arranged along the longitudinal axis of the collector tube, subdividing the collector tube into two or more collector channels, wherein the collector tube is formed from two metal sheets, in that openings to accept the ends of the flat tubes are provided in at least one of the metal sheets, and in that each longitudinal separating wall is provided with tongue-like projections, which are arranged in grooves in at least one of the metal sheets and are fixed to the outside of the metal sheet, wherein the longitudinal separating wall in the area of the openings in one of the metal sheets exhibits recesses which function as a stop for the tube, wherein the recesses are embodied with a tear-shaped form, and wherein said tear-shaped recesses comprise recesses having an open first end having a first width and an inner portion having a second width greater than said first width and a closed, curved second end.

2. A heat exchanger as claimed in claim 1, wherein the recesses exhibit an inlet area or an outlet area for the flat tube.

3. A heat exchanger as claimed in claim 1, wherein the longitudinal separating wall adjacent to the recesses exhibits further overflow openings.

4. A heat exchanger as claimed in claim 1, wherein the two metal sheets overlap with their longitudinal edges.

5. A heat exchanger as claimed in claim 1, wherein the longitudinal separating wall is embodied with tongue-like projections in the form of a tie bolt separating wall comprising several individual tie bolts arranged parallel to one another.

6. A heat exchanger as claimed in claim 5, wherein the number of tongue-like projections corresponds to the number of tie bolts.

7. A heat exchanger comprising:

a plurality of flat tubes arranged parallel to one another in two or more rows;

a collector tube comprising first and second metal sheets, the first metal sheet including a plurality of openings configured to receive ends of the plurality of flat tubes and also including a plurality of grooves spaced from the openings; and a longitudinal separating wall in the collector tube comprising a third, planar, metal sheet arranged along a longitudinal axis of the collector tube and subdividing the collector tube into two collector channels, the longitudinal separating wall including a first plurality of planar tongue-like projections extending through the grooves in the first metal sheet, wherein the longitudinal separating wall includes a second plurality of planar tongue-like projections extending away from the first plurality of planar tongue-like projections through grooves in the second metal sheet, and wherein the longitudinal separating wall includes tear-shaped recesses having an open first end having a first width and an inner portion having a second width greater than said first width and a closed, curved second end.

8. The heat exchanger of claim 7 wherein the planar, tongue-like projections are bent over an outside surface of the first metal sheet.

* * * * *